US006809993B1

(12) United States Patent
Müller et al.

(10) Patent No.: US 6,809,993 B1
(45) Date of Patent: Oct. 26, 2004

(54) ELECTRONIC TIMEPIECE INCLUDING A TIME RELATED DATA ITEM BASED ON A DECIMAL SYSTEM

(75) Inventors: Jacques Müller, Reconvilier (CH); Pascal Derivaz, Le Bouveret (CH); Roger Marquis, Courchapoix (CH)

(73) Assignee: Swatch AG, Bienne (CH)

( * ) Notice: Subject to any disclaimer, the term of this patent is extended or adjusted under 35 U.S.C. 154(b) by 0 days.

(21) Appl. No.: 09/763,691

(22) PCT Filed: Aug. 24, 1999

(86) PCT No.: PCT/CH99/00387

§ 371 (c)(1),
(2), (4) Date: Feb. 26, 2001

(87) PCT Pub. No.: WO00/13067

PCT Pub. Date: Mar. 9, 2000

(30) Foreign Application Priority Data

Aug. 28, 1998 (CH) ..... 1764/98

(51) Int. Cl.[7] ..... G04C 17/00; G04B 19/04
(52) U.S. Cl. ..... 368/242; 368/238; 368/239
(58) Field of Search ..... 368/107, 76, 223, 368/242, 80, 228, 238, 241, 239, 282

(56) References Cited

U.S. PATENT DOCUMENTS

| | | | | |
|---|---|---|---|---|
| 3,284,715 A | | 11/1966 | Kaminsky | |
| 3,777,471 A | | 12/1973 | Koehler et al. | |
| 3,975,898 A | | 8/1976 | Nishimura | |
| 4,175,378 A | * | 11/1979 | Shelton | 346/20 |
| 4,185,452 A | * | 1/1980 | Ikeda | 368/76 |
| 4,413,350 A | | 11/1983 | Bond et al. | |
| 4,926,400 A | | 5/1990 | Rachofsky et al. | |
| 5,444,674 A | * | 8/1995 | Sellie | 368/107 |
| 5,771,180 A | | 6/1998 | Culbert | |
| 6,579,004 B1 | * | 6/2003 | Kim | 368/295 |
| 2002/0118606 A1 | * | 8/2002 | Albisetti et al. | 368/80 |

FOREIGN PATENT DOCUMENTS

| | | | | |
|---|---|---|---|---|
| FR | 2622315 | * | 4/1989 | 368/232 |
| GB | 2 274 004 A | | 7/1994 | |
| WO | WO 99/38053 | | 7/1999 | |

OTHER PUBLICATIONS

T. Raja RAO: "Time and Its Units." Journal of the Institution of Engineers (India) Industrial Development and General Engineering, Sept. 1973, pp. 25–28, vol. 54, No. 01.
International Search Report, by U. Exelmans, Nov. 17, 1999, 3 pages.

* cited by examiner

*Primary Examiner*—Tulsidas Patel
*Assistant Examiner*—Jeanne-Marguerite Goodwin
(74) *Attorney, Agent, or Firm*—Griffin & Szipl, P.C.

(57) ABSTRACT

The present invention relates to an electronic timepiece allowing the display of at least one first time related data item ($H_1$) conventionally based on the Hour-Minute-Second system, and at least one second time related data item ($H_2$) based on a decimal system in which the time is divided at least into thousandths of a day. For this purpose the timepiece according to the present invention includes generating means (14) which, from auxiliary control pulses ($I_L$) originating from the time base (2), allow second control pulses ($I_2$) to be supplied allowing said second time related data item ($H_2$) to be formed and displayed.

21 Claims, 6 Drawing Sheets

ELECTRONIC TIMEPIECE INCLUDING A TIME RELATED DATA ITEM BASED ON A DECIMAL SYSTEM

FIELD OF THE INVENTION

The present invention relates to an electronic timepiece allowing the display of several time related data. More particularly, the present invention relates to a timepiece allowing the display of at least a first and a second time related data item, the first time related data item being based on the Hour-Minute-Second system (hereinafter H-M-S).

BACKGROUND OF THE INVENTION

Electronic timepieces allowing the display of a plurality of time related data are already known in the prior art. These timepieces, commonly called <<universal timepieces>> are typically provided to allow the display of a time related data item representative of a universal time and one or more time related data representative of local times corresponding to different time zones. This multitude of time related data can cause a risk of confusion for the user when they are read and generally requires means to be provided to allow clear identification of what each of the displayed time date refers to.

U.S. Pat. No. 4,926,400 describes an electronic timepiece in accordance with the preamble part of independent claim 1. This timepiece allows the display of a first time related data item based on the H-M-S system and of a second time related data item based on a non-decimal system in which time is divided into twenty-five 25ths of a day. In accordance with table 1, column 3, of this document, one day (24 hours) is divided into 25 "hours" of 60 "minutes" each, each "minute" including 57.6 seconds. Every "minute", 2.4 seconds are thus "saved" so as to form an additional simulated hour. The display modes of the "24 h" and "25 h" time related data items are identical. Without any complementary indications, the user of such a timepiece will not be able to clearly differentiate between these two time related data items.

One object of the present invention is thus to provide an electronic timepiece allowing the display of at least a first and a second time related data item, by means of which the user can dearly and quickly identify and differentiate between the displayed time related data.

SUMMARY OF THE INVENTION

The present invention therefore concerns an electronic timepiece allowing the display of at least a first and a second time related data item. More particularly, the present invention concerns an electronic timepiece allowing the display of at least a first and a second time related data item, said first time related data item being based on the Hour-Minute-Second system, this timepiece including: (a) a time base supplying pulses to a frequency divider circuit including N binary division stages and supplying first control pulses allowing said first time related data item to be formed and displayed; and this timepiece further includes (b) generating means arranged to supply, from auxiliary control pulses originating from said time base, second control pulses allowing said second time related data item to be formed and displayed, wherein said second time related data item is based on a decimal system in which the time is divided at least into thousandths of a day and wherein said second time related data item is displayed with three digits so that said second time related data item cannot be confused with said first time related data item.

The solution advocated by the present invention thus allow the first time related data item to be clearly differentiated from the second due to the fact that the first and second time related data items are based on different systems.

The H-M-S system conventionally used consists of dividing the day into 24 hours, 1 hour being divided into 60 minutes, and 1 minute into 60 seconds. A time division based on the decimal system on the other hand consists in dividing the day, not in accordance with the aforementioned conventional scheme, but successively, into tenths of a day (equivalent to 2.4 hours or 144 minutes), which are themselves divided into hundredths of a day (equivalent to 14.4 minutes or 864 seconds), then into thousandths of a day (equivalent to 86.4 seconds) etc.

In particular, by selecting a division of time into thousandths of a day, the second time related data item only requires three digits (<<000>> to <<999>>) to be displayed and is thus clearly distinguished from a conventional time related data item based on the H-M-S system typically displayed in the format <<HH:MM>>. The risk of confusion during reading of the time related data is thus greatly reduced.

The atypical format of the second time related data item proves for example particularly suitable for displaying a universal time to which the user can clearly refer without confusing it with a conventional time related data item relating to the time zone in which he is situated.

The decimal system further constitutes an advantageous alternative to the H-M-S system conventionally used since it allows the inherent conversion problems of the H-M-S system to be avoided. This alternative is moreover more logical and comprehensible for the user who is already accustomed to the decimal system.

It is to be pointed out that patent application GB-A-2 274 004 and the article "Time and Its Units" of Mr. T. Raja Rao, "JOURNAL OF THE INSTITUTION OF ENGINEERS (INDIA) INDUSTRIAL DEVELOPMENT AND GENERAL ENGINEERING", vol. 54, September 1973, pages 25–28, (XP-002101432), both describe the use of a decimal system as an alternative to the conventional H-M-S system as well as a timepiece allowing a single time indication data item based on such a decimal system to be displayed.

In order to form a time related data item based on the H-M-S system, electronic timepieces commonly include a time base, typically a quartz oscillator supplying pulses at a determined frequency equivalent to a binary power, for example 32,768 Hz. A frequency divider circuit, formed of a succession of N binary division stages (flip-flops) connected in cascade, is coupled to the time base so as to supply control pulses whose frequency is reduced by a factor $2^N$. Typically, this frequency divider circuit is formed of N=15 binary division stages, so that the frequency of the pulses supplied by the time base is reduced to 1 Hz. In electronic timepieces allowing the display of several distinct time related data, these control pulses are thus used to control the respective displays of these time related data.

In order to form the second time related data item based on the selected decimal system, it is a priori possible to periodically perform an arithmetical conversion operation on a conventional time related data item based on the H-M-S system. This trivial solution consists, in other words, in providing conversion or calculating means dedicated to this task. It will be noted however that this solution is not suitable for use in a timepiece since it will preferably be sought to provide means allowing control pulses, which allow the second time related data item based on the decimal system to be formed and displayed, to be generated directly.

In order to generate control pulses allowing a time related data item based on the decimal system to be formed in which the time is divided at least into thousandths of a day, it is necessary to generate such pulses at least at a frequency of 1186.4 Hz or a decimal multiple of this frequency, i.e. 1/8.64 Hz for a division into ten-thousandths of a day, 1/0.864 Hz for a division into a hundred-thousandths of a day, etc. In practice, one will choose to generate the second control pulses either at a frequency of 1/86.4 Hz or at a frequency of 1/8.64 Hz, higher frequencies being however able to be chosen as required.

A trivial solution to this problem consists in providing an additional time base allowing pulses to be supplied at a specific frequency corresponding to a multiple of the desired frequency, for example 10,000 Hz. A frequency divider circuit having for example a division ratio equivalent to 86,400 would thus allow control pulses to be generated at a frequency of 1/8.64 Hz. This trivial solution thus involves the use of two distinct division chains (time base+frequency divider circuit) to display the first and second time related data items. It will however be sought to limit the number of components necessary to generate the control pulses and in particular to use only one time base, and preferably a horological time base, i.e. a time base supplying pulses at a frequency equivalent to a binary power.

Means for generating clock pulses which might be used within the scope of the present invention are for example disclosed in documents U.S. Pat. No. 3,975,898, U.S. Pat. No. 5,771,180, U.S. Pat. No. 3,777,471 and U.S. Pat. No. 3,284,715.

According to the present invention, the timepiece is advantageously arranged to derive the control pulses of the first and second time related data items from the same time base. It includes for this purpose generating means arranged to supply, from auxiliary control pulses originating from the time base, the second control pulses allowing the second time related data item to be formed and displayed. The timepiece can thus be arranged in particular to derive, from pulses at 1 Hz originating from the time base at the output of the frequency divider circuit, second control pulses having a frequency of 1/86.4 Hz in order to form a second time related data item to a thousandth of a day, despite the fact that the division ratio of these frequencies is not integer.

Another advantage of the present invention thus lies in the fact that only one time base is used to generate the different control pulses of the first and second time related data items and that it is consequently possible to adapt the electronic system of a conventional timepiece so that it allows the display of a time related data item based on the decimal system.

BRIEF DESCRIPTION OF THE DRAWINGS

Other features and advantages of the present invention will appear upon reading the following detailed description, made with reference to the annexed drawings given solely by way of example and in which.

DETAILED DESCRIPTION OF THE ILLUSTRATIVE EMBODIMENTS

Figure 1:
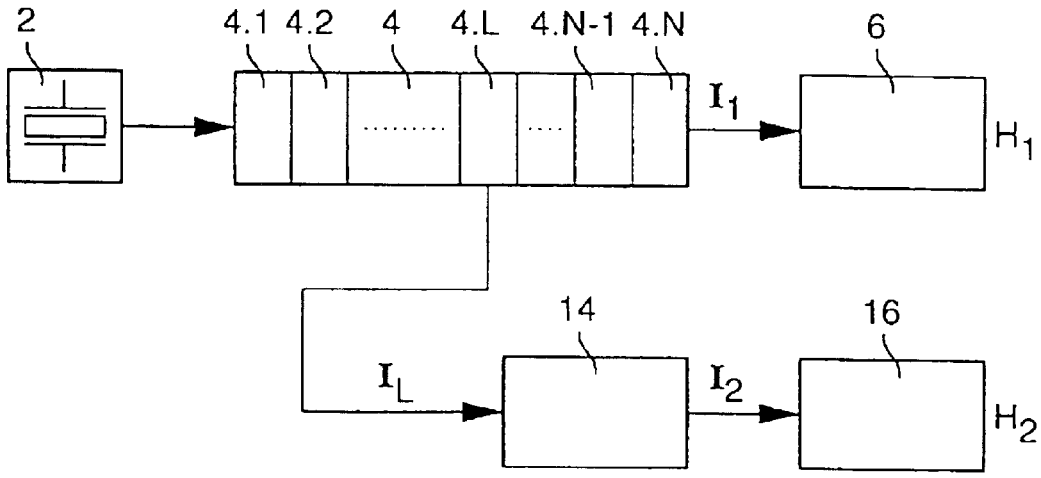
FIG. 1 shows a simplified block diagram of a timepiece constituting a first embodiment of the present invention.

FIG. 1 shows, in the form of a simplified block diagram, a timepiece constituting a first embodiment of the present invention. This timepiece includes in series a time base 2, typically formed of a quartz oscillator, a frequency divider circuit 4 including N binary division stages 4.1 to 4.N and supplying first control pulses $I_1$, and first display means 6 controlled by first control pulses $I_1$. A quartz oscillator supplying pulses at a frequency of 32,768 Hz and a frequency divider circuit including N=15 binary division stages will typically be used, so as to generate first control pulses $I_1$ having a frequency of 1 Hz. In the following description, the aforementioned numerical values will be used by way of non limiting example.

First display means 6 are controlled by first control pulses land are arranged in a conventional manner so that they allow a first time related data item $H_1$ based on the H-M-S system, to be formed and displayed.

The timepiece according to the present invention further include generating means 14 supplying second control pulses $I_2$ whose frequency is determined by the decimal division adopted, namely for example 1/86.4 Hz in the case where a division into thousandths of a day is adopted. These generating means 14 are controlled by auxiliary control pulses $I_L$, originating from time base 2 and supplied, in this embodiment, at the output of one of binary division stages 4.1 to 4.N of frequency divider circuit 4, this stage being indicated by the reference 4.L and being able to be chosen from among the group of binary division stages 4.1 to 4.N. It will be noted that the frequency of auxiliary control pulses $I_L$ is equivalent to the frequency of the pulses supplied by time base 2 reduced by a factor of $2^L$.

Alternative embodiments of generating means 14 will be presented in more detail in the following description.

Second display means 16 are connected in series with generating means 14. These second display means 16 are controlled by the second control pulses $I_2$ and are arranged so that they allows a second time related data item $H_2$, based on the decimal system to be formed and displayed.

Figure 2:
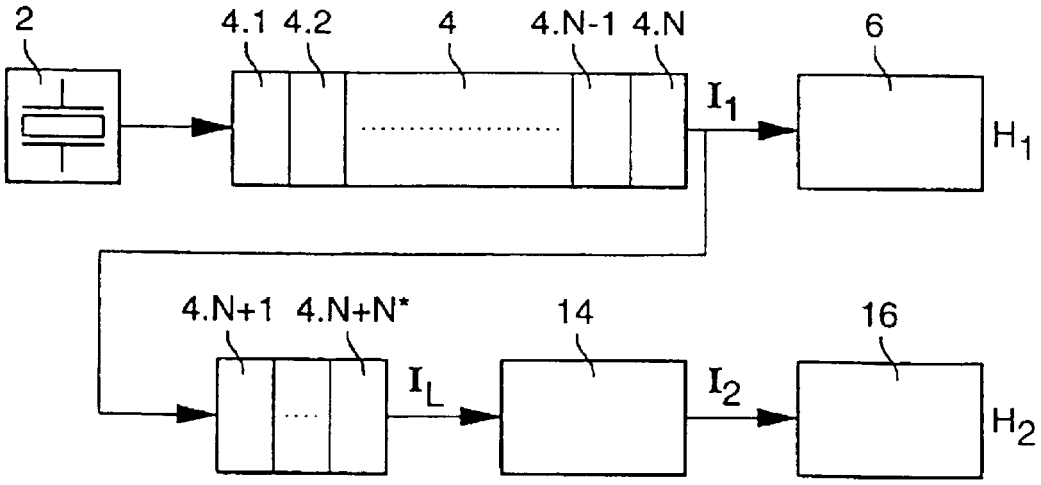
FIG. 2 shows a simplified block diagram of a timepiece constituting a second embodiment of the present invention.

FIG. 2 shows, in the form of a simplified block diagram, a timepiece constituting a second embodiment of the present invention. This timepiece includes in series, time base 2, frequency divider circuit 4, first and second display means 6 and 16, as well as generating means 14 for second control pulses $I_2$.

This timepiece further includes N* additional binary division stages 4.N+1 to 4.N+N* connected after frequency divider circuit 4. Generating means 14 are controlled by auxiliary control pulses $I_L$ also originating from time base 2 and supplied, in this embodiment, at the output of additional binary division stages 4.N+1 to 4.N+N*. It will be noted that the frequency of auxiliary control pulses $I_L$ is equivalent, in this case, to the frequency of the pulses supplied by time base 2 reduced by a factor of $2^{N+N^*}$.

The embodiments illustrated in FIGS. 1 and 2 thus allow the display of a first time related data item $H_1$, based on the H-M-S system, and a second time related data item $H_2$, based on the decimal system. In these two embodiments, the second control pulses $I_2$ are thus generated from auxiliary control pulses $I_L$ originating from time base 2.

It will be noted that the timepiece according to the present invention further includes correction means allowing different time related data to be adjusted. These correction means have not been described here and are not shown in FIGS. 1 and 2. Those skilled in the art will however know how to make these correction means so that they allow each time related data item to be adjusted in a suitable manner.

It will further be noted that the embodiments shown in FIGS. 1 and 2 are in no way limiting. In particular, additional display means can further be provided so as to allow additional time related data based on the H-M-S system or the decimal system to be formed and displayed.

It will also be noted that those skilled in the art will know how to make display means 6 and 16 in a suitable manner. It will be noted in particular that these means may advantageously be made in the form of an analogue hand display controlled by electromechanical means or in the form of a digital display. By way of example, FIGS. 3*a* and 3*b* show plane views of timepieces according to the present invention illustrating different possibilities for the display of time related data $H_1$ and $H_2$.

Figure 3A:
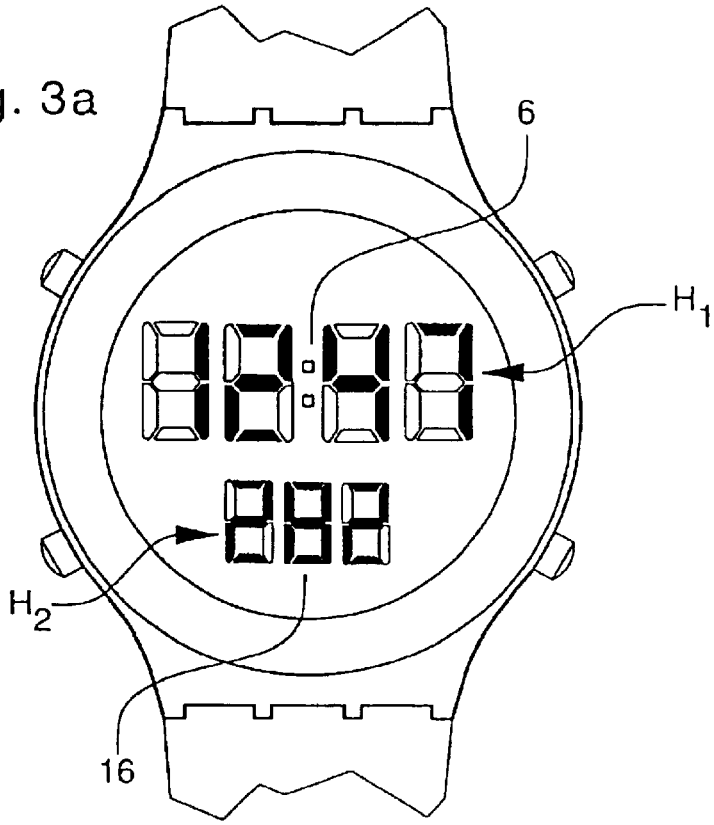
FIGS. 3*a* and 3*b* show plane view of timepieces according to the present invention illustrating different possibilities for the display of the time related data.

As is illustrated in FIG. 3*a*, first display means 6 of first time related data item $H_1$ can be made in the form of a digital display allowing, for example, the display of time related data item $H_1$ in accordance with a conventional "HM:MM" format. Alternatively, these first display means can for example include, as is shown in FIG. 3*b*, first and second hands driven by electromechanical means (not shown) and allowing respectively the display of the hours and the minutes.

Figure 3B:
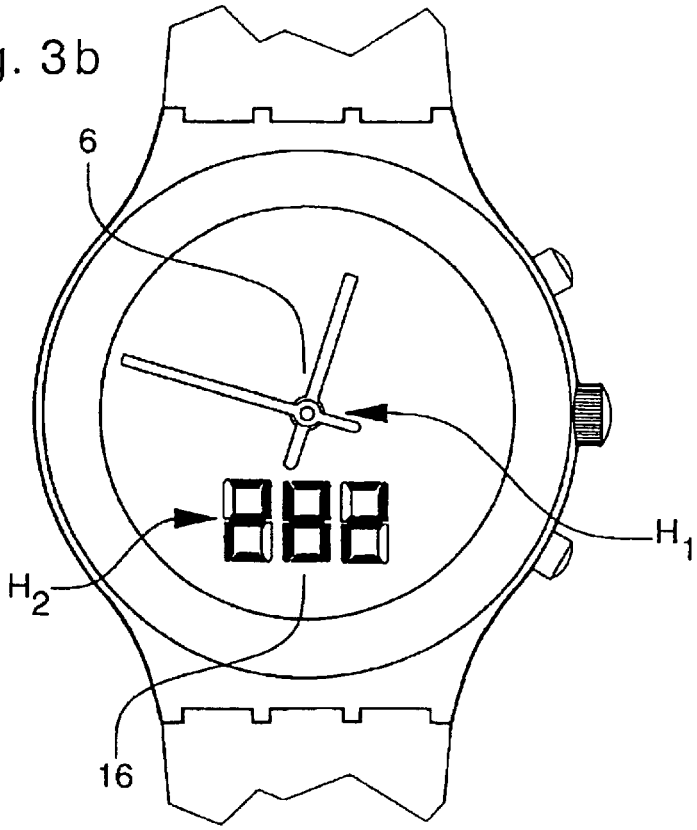

Second display means 16 of second time related data item $H_2$ are advantageously formed, as is illustrated in FIGS. 3*a* and 3*b*, of a digital display including, in this example, 3 digits so as to allow the display of the second time related data item $H_2$ in thousandths of a day. These second display means 16 may however also be made in the form of an analogue hand display driven by electromechanical means in a similar way to first display means 6 illustrated in FIG. 3*b*.

Figure 4:
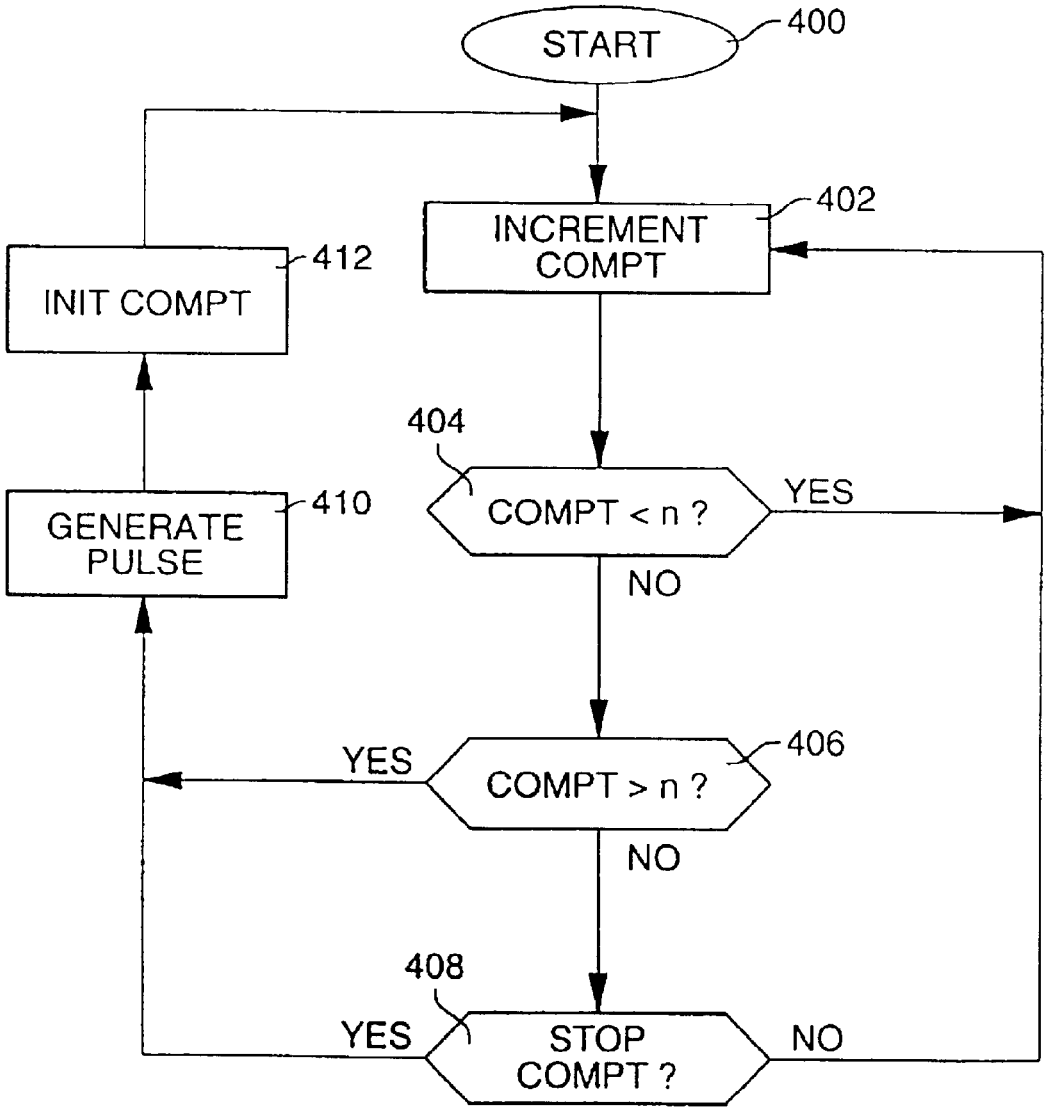
FIG. 4 shows a flow chart of the implementation of a first alternative embodiment of the generating means allowing control pulses to be supplied for the display of the time related data item based on the decimal system.
Figure 5:
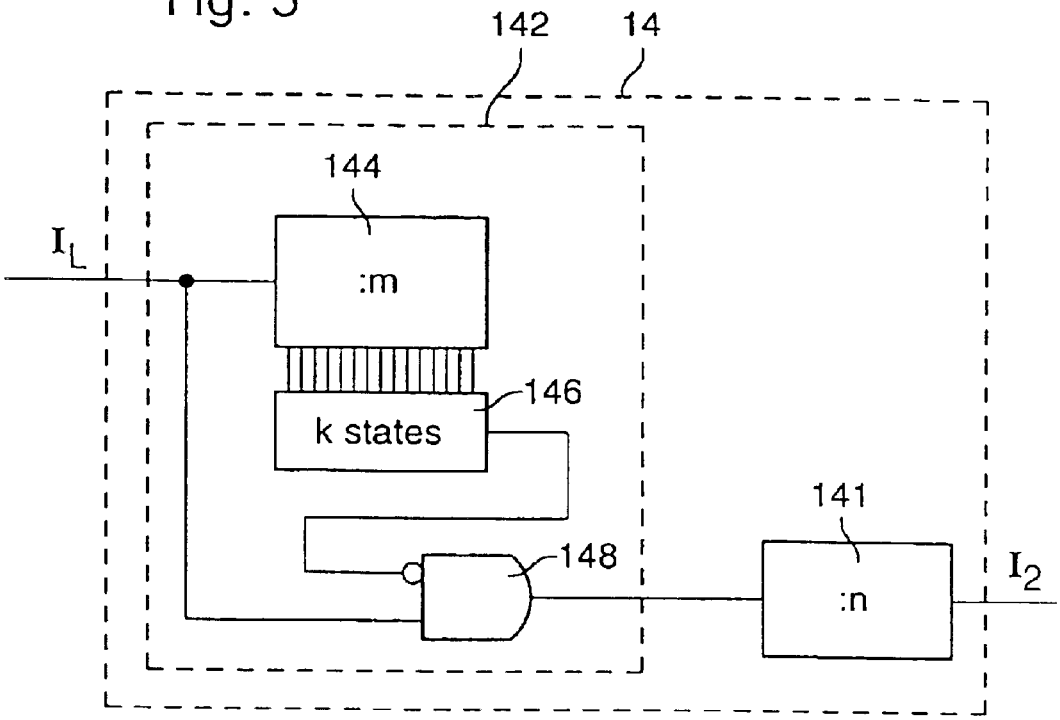
FIG. 5 shows a second alternative embodiment of the generating means allowing control pulses to be supplied for the display of the time related data item based on the decimal system.
Figure 6:
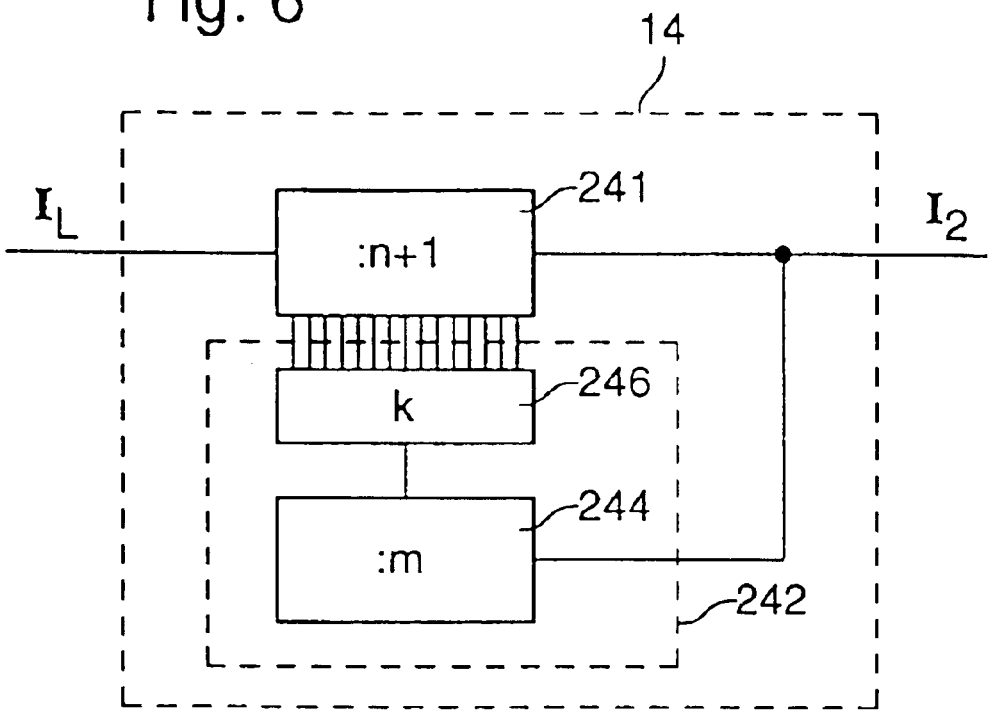
FIG. 6 shows a third alternative embodiment of the generating means allowing the control pulses to be supplied for the display of the time related data item based on the decimal system.

With reference to FIGS. 4 to 6 various alternative embodiments of generating means 14 allowing second control pulses $I_2$ to be supplied according to the invention will now be described.

It will be recalled that, according to the case being considered, i.e. for example a division into thousandths (86.4 seconds) or alternatively into ten-thousandths (8.64 seconds) of a day, second control pulses $I_2$ have to be supplied at a frequency of 1/86.4 Hz or 1/8.64 Hz respectively.

It will also be recalled that in the following description one will assume by way of non limiting example that time base 2 typically supplies pulses at a frequency of 32,768 Hz so that N=15 binary division stages 4.1 to 4.15 allow first control pulses $I_1$ to be supplied at a frequency of 1 Hz.

Auxiliary control pulses $I_L$ are used, according to the present invention, to generate second control pulses $I_2$. The frequency of auxiliary control pulses $I_L$ is determined by the binary division stage at the output of which they are supplied. According to the first embodiment described in FIG. 1, this frequency is thus equal to the frequency of the pulses supplied by time base 2 reduced by a factor of $2^L$. According to the second embodiment described in FIG. 2, this frequency is equal to the frequency of the pulses supplied by time base 2 reduced by a factor $2^{N+N^*}$.

The frequency division ratio of auxiliary control pulses $I_L$ by the frequency of second control pulses $I_2$ defines a numerical value corresponding to the mean number of auxiliary control pulses $I_L$ to be counted to generate a control pulse $I_2$. Given that the frequency of the pulses supplied by time base 2 is typically equivalent to a binary power, the division ratio defines a non integer numerical value due to the decimal division of the day.

It will be noted that it is not possible to count a non integer number of auxiliary control pulses $I_L$. Consequently, within the scope of the present invention, integer numbers n and n+1 are defined respectively directly less than and greater than the aforementioned division ratio. These integer numbers n and n+1 thus correspond respectively to the integer numbers directly less than and greater than the mean number of auxiliary control pulses $I_L$ to be counted to generate a control pulse $I_2$.

In order for second control pulses $I_2$ to be generated at a mean frequency corresponding to the desired frequency, i.e. for example 1/86.4 Hz or 1/8.64 Hz, n and n+1 auxiliary control pulses $I_L$ are thus successively counted in accordance with a determined counting sequence.

This counting sequence is formed of a succession of counting operations of n and n+1 auxiliary control pulses $I_L$. The division ratio defined hereinbefore determines the period as well as the number of counting operations at the end of which second control pulses $I_2$ are generated at the desired mean frequency.

This counting sequence is further preferably formed so that the spaces generated during the counting sequence are reduced to a minimum.

By way of example, in the case where second control pulses $I_2$ are generated at a mean frequency of 1/86.4 Hz from auxiliary control pulses $I_L$ at 1 Hz, i.e. in the case in which generating means 14 are connected to the last binary division stage 4.N of frequency divider circuit 4 (according to the first embodiment shown in FIG. 1), the frequency division ratio is equal to 86.4. Generating means 14 are thus arranged to count successively n=86 and n+1=87 auxiliary control pulses $I_L$.

The division ratio further defines that 5 control pulses $I_2$ must be generated during one period of 432 seconds. In this case, the counting sequence, repeated 200 times over a duration of 24 hours, is thus formed of a succession of 5 counting operations. In the present case, n=86 and n+1=87 auxiliary control pulses $I_L$ are respectively counted 3 and 2 times during the 432 seconds, so that the mean frequency at which second control pulses $I_2$ are supplied is thus equal to 1/86.4 Hz.

In order for the spaces generated during the counting sequence to be reduced to a minimum, the 5 control pulses $I_2$ are preferably generated in accordance with the following counting sequence:

86-87-86-87-86

In such case, it will be noted that the maximum time error generated during the counting sequence is thus limited to +/−0.4 seconds, i.e. of the order of 0.5% of the period of second control pulses $I_2$.

Similarly, in the event that second control pulses $I_2$ are generated at a mean frequency of 1/86.4 Hz from auxiliary control pulses $I_L$ at 1/8 Hz, i.e. in the event that generating means 14 are connected to the output of N*=3 additional binary division stages (according to the second embodiment shown in FIG. 2), the frequency division ratio is equal to 10.8. Generating means 14 are thus arranged to count successively n=10 and n+1=11 auxiliary control pulses $I_L$.

The division ratio further defines that 5 control pulses $I_2$ must be generated during one period of 432 seconds. In this case, the counting sequence, repeated 200 times over a duration of 24 hours, is thus formed of a succession of 5 counting operations. In the present case, n=10 and n+1=11 auxiliary control pulses $I_L$ are respectively counted 1 and 4 times during the 432 seconds, so that the mean frequency at which second control pulses $I_2$ are supplied is thus equal to 1/86.4 Hz.

In order for the spaces generated during the counting sequence to be reduced to a minimum, the 5 control pulses $I_2$ are preferably generated in accordance with the following counting sequence:

11-11-10-11-11

In such case, it will be noted that the maximum time error generated during the counting sequence is thus limited to +/−3.2 seconds, i.e. of the order of 4% of the period of second control pulses $I_2$.

Similarly, in the event that second control pulses $I_2$ are generated at a mean frequency of 1/8.64 Hz from auxiliary control pulses $I_L$ at 1 Hz, i.e. in the event that generating means 14 are connected to the output of the last binary division stage 4.N of frequency divider circuit 4 (according to the first embodiment shown in FIG. 1), the frequency division ratio is equal to 8.64. Generating means 14 are thus arranged to count successively n=8 and n+1=9 auxiliary control pulses $I_L$.

The division ratio further defines that 25 control pulses $I_2$ must be generated during one period of 216 seconds. In this case, the counting sequence, repeated 400 times over a duration of 24 hours, is thus formed of a succession of 25 counting operations. In the present case, n=8 and n+1=9 auxiliary control pulses $I_L$ are respectively counted 9 and 16 times during the 216 seconds, so that the mean frequency at which second control pulses $I_2$ are supplied is thus equal to 1/8.64 Hz.

In order for the spaces generated during the counting sequence to be reduced to a minimum, the 25 control pulses $I_2$ are preferably generated in accordance with the following counting sequence:

9,-8,-9,-9,-8,-9,-8,-9,-9,-8,-9,-9,-8,-9,-9,-8,-9,-9,-8,-9,-8,-9,-9,-8,-9

In such case, it will be noted that the maximum time error generated during the counting sequence is thus limited to +/−0.48 seconds, i.e. of the order of 5.5% of the period of second control pulses $I_2$.

Generally, it will be noted that the choice of auxiliary control pulses $I_L$ determines on the one hand the accuracy with which second control pulses $I_2$ are generated, and on the other hand, the size of the registers/counters necessary for counting auxiliary control pulses $I_L$.

Various alternative embodiments of generating means 14 based on the aforementioned principle will now be described.

FIG. 4 shows a flow diagram of the implementation of generating means 14 constituting a first alternative embodiment according to the present invention. According to this first variant, generating means 14 can advantageously be made in the form of an integrated circuit including a programmed microprocessor. Those skilled in the art will know, from the indications provided here, how to program the microprocessor, so as to allow it to perform the functions described.

With reference to the flow diagram illustrated in FIG. 4, the counting sequence begins at the block indicated by the reference 400.

At block 402, a counting register COMPT is incremented at each auxiliary control pulse $I_L$ This counting register COMPT includes a sufficient number of bits to allow the counting of at least n+1 auxiliary control pulses $I_L$. By way of example, in order to allow counting of n+1=87 auxiliary control pulses $I_L$, this counting register COMPT includes at least 7 bits.

A first test is effected at block 404 so as to check whether the value of counting register COMPT has reached value n. Counting register COMPT is incremented at block 402 at each auxiliary control pulse $I_L$ as long as the value thereof is less than value n, this being indicated by the affirmative output of test block 404.

When the value of counting register COMPT reaches value n, represented by the negative output of test block 404, a second test is then performed at block 406 so as to check whether the value of counting register COMPT has passed value n.

The negative output of test block 406 leads to the third test indicated at block 408. At this stage, it is checked whether, according to the counting sequence, counting register COMPT has to be stopped at value n. If necessary, a control pulse $I_2$ is generated at block 410, i.e. after the counting of n auxiliary control pulses $I_L$. In the contrary case, counting register COMPT is incremented at block 402 and, following the affirmative result of the test performed at block 406, the control pulse $I_2$ is then generated at block 410, i.e. after the counting of n+1 auxiliary control pulses $I_L$.

Following the generation of control pulse $I_2$ at block 410, counting register COMPT is initialised at block 412 and the process begins again at block 400.

In order to perform the test indicated at block 408 it is convenient to use a table representing the counting sequence and consequently including as many entries as there are counting operations.

This table preferably includes binary values representing the counting operation to be performed, i.e. for example the binary value <<0>> if n auxiliary control pulses $I_L$ have to be counted or the binary value <<1>> if n+1 auxiliary control pulses $I_L$ have to be counted. In this case, a binary word including as many bits as there are counting operations allows the table representing the counting sequence to be easily formed.

The use of a table representing the counting sequence is not however necessary in all cases. As will be seen hereinafter with reference to different embodiment examples, certain alternatives and simplifications could be envisaged.

It will also be mentioned that the process described hereinbefore is preferably executed in phase with the current value of the second time related data item $H_2$ so as to assure that the counting sequence is not out of phase therewith. A register containing the value of the second time related data item $H_2$ being displayed will preferably be used so as to determine which counting operation needs to be performed.

In particular, in the event that a table is used, the register containing the value of the second time related data item $H_2$ being displayed allows an indexation value to be defined for the various table entries by a simple modulo calculation. Modulo of course means the arithmetical calculation giving the remainder of a division by a determined number.

In the case already discussed hereinbefore in which second control pulses $I_2$ are generated at a mean frequency of 1/86.4 Hz from auxiliary control pulses $I_L$ at 1 Hz, it will be recalled that the counting sequence is preferably determined so that 5 control pulses $I_2$ are generated in accordance with the following counting sequence:

86-87-86-87-86

This counting sequence can thus be represented by a table with 5 entries, preferably made using the following 5 bit word:

<<0 1 0 1 0>>

With reference once again to FIG. 4. the test which is performed at block 408 is thus carried out by seeking the corresponding value in the table.

Preferably, a register containing the value of the second time related data item $H_2$ being displayed will be used, or at least the value (0 to 9) of the thousandths of a day displayed. A modulo-5 operation on the value of this register thus allows an indexation value (0 to 4) to be obtained from the table.

In this example, one alternative to using the table consists in directly using the result of the modulo-5 operation on the register containing the value of the thousandths of a day displayed. It will be noted that, in this example, the counting operations by n=86 and n+1=87 are alternated. Consequently, it is possible to determine whether n auxiliary control pulses $I_L$ have to be counted checking whether the result of the modulo-5 operation is an even number. Respectively, it is determined whether n+1 auxiliary control pulses $I_L$ have to be counted checking whether the result is an odd number.

In the case already discussed hereinbefore in which second control pulses $I_2$ are generated at a mean frequency of 1/86.4 Hz from auxiliary control pulses $I_L$ at 1/8 Hz, it will be recalled that the counting sequence is preferably determined so that 5 control pulses $I_2$ are generated in accordance with the following counting sequence:

11-11-10-11-11

This counting sequence can thus be represented by a table with 5 entries, preferably made using the following 5 bit word:

<<1 1 0 1 1>>

In this case also, a register containing the value of the thousandths of a day displayed will be used, in order to obtain from the table via a modulo-5 operation an indexation value (0 to 4).

In the case already discussed hereinbefore in which second control pulses $I_2$ are generated at a mean frequency of 1/8.64 Hz from auxiliary control pulses $I_L$ at 1 Hz, it will be recalled that the counting sequence is preferably determined so that 25 control pulses $I_2$ are generated in accordance with the following counting sequence:

9-8-9 -9-8-9 -8-9-9 -8-9-9 -8-9-9 -8-9-9 -8-9-8 -9-9-8-9

This counting sequence can thus be represented by a table with 25 entries, preferably made using the following 25 bit word:

<<1 0 1 1 0 1 0 1 1 0 1 1 0 1 1 0 1 1 0 1 0 1 1 0 1>>

With reference once again to FIG. 4, the test which is performed at block 408 is thus carried out by seeking the corresponding value in the table.

Preferably, a register containing at least the value (0 to 99) of the thousandths and ten-thousandths of a day displayed will be used. A modulo-25 operation on the value of this register thus allows an indexation value (0 to 24) to be obtained from the table.

FIG. 5 illustrates a second alternative embodiment of generating means 14 allowing second control pulses $I_2$ to be supplied.

As is shown in FIG. 5, these generating means 14 include a primary counter 141 arranged to count n auxiliary control pulses $I_L$, and inhibition means 142 of primary counter 141. Inhibition means 142 are controlled by auxiliary control pulses $I_L$ and are situated upstream of primary counter 141 so as to periodically inhibit a determined number of auxiliary control pulses $I_L$ at the input thereof. Second control pulses $I_2$ are supplied at the output of primary counter 141.

Inhibition means 142 preferably include a secondary counter 144 arranged to count m auxiliary control pulses $I_L$, a logic detection circuit 146 coupled to different stages of secondary counter 144 so as to detect k intermediate states thereof (selected from among states 0 to m-1) during which auxiliary control pulses $I_L$ are inhibited, and a logic AND gate, indicated by the reference 148, including 2 inputs, one being inverted and connected to the output of logic detection circuit 146 and the other receiving auxiliary control pulses $I_L$.

Inhibition means 142 thus allow k auxiliary control pulses $I_L$ to be inhibited periodically upstream of primary counter 141, i.e. during a period in which m pulses $I_L$ are supplied.

When one of the k intermediate states is detected by logic detection circuit 146, the latter thus sends an inhibition signal blocking the output of the logic AND gate for the duration of one auxiliary control pulse $I_L$ so that primary counter 141 does not <<see>> this pulses and does not take it into account.

The k intermediate states will preferably be chosen so that they are equidistant from each other, in order to minimise the spaces generated.

Figure 5A:
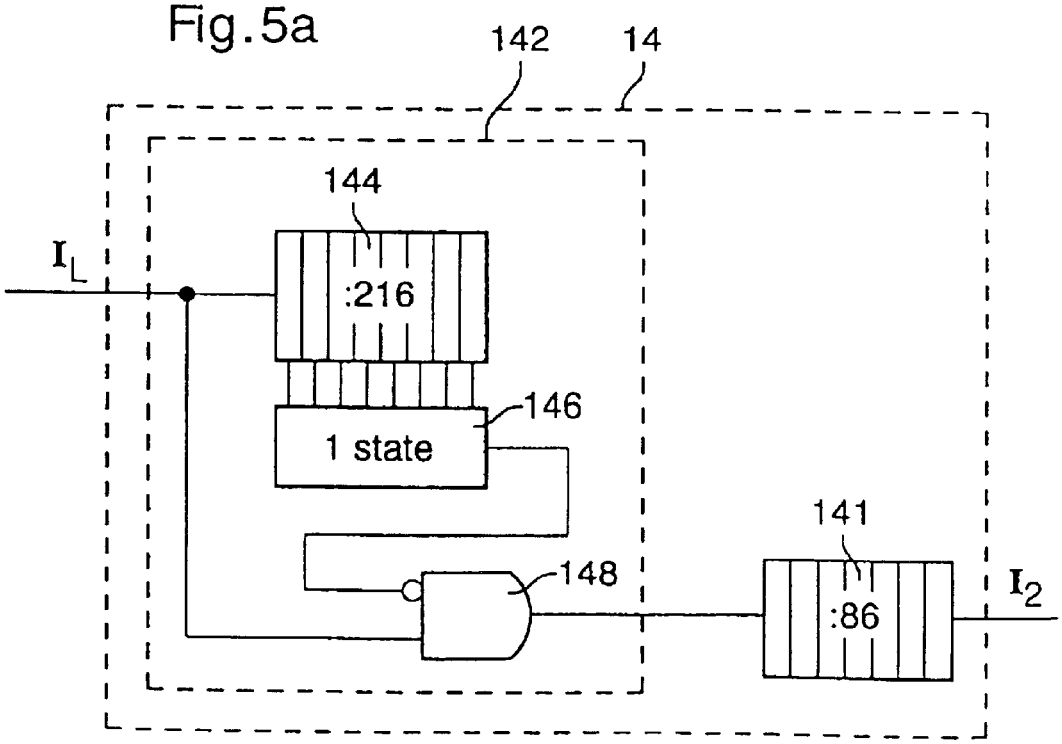
FIGS. 5*a* to 5*c* show examples of the application of the second alternative embodiment of generating means 14 illustrated in FIG. 5.

FIG. 5*a* illustrates a first example of the second alternative embodiment shown in FIG. 5, applied to the case in which second control pulses $I_2$ are generated at a mean frequency of 1/86.4 Hz from auxiliary control pulses $I_L$ having a frequency of 1 Hz, i.e. in the case in which generating means 14 are connected to the output of the last binary division stage 4.N of frequency divider circuit 4 (in accordance with the first embodiment shown in FIG. 1).

It will be recalled that the division ratio between the frequency of auxiliary control pulses $I_L$ and the frequency of the second control pulses is equal in this case to 86.4. Primary counter 141 is thus formed of a counter by n=86. It follows that 2 auxiliary control pulses $I_L$ must be inhibited during the period (432 seconds) in which 432 auxiliary control pulses $I_L$ are supplied, i.e., by simplification, 1 pulse per 216. For this purpose, secondary counter 144 is formed of a counter by m=216 and logic detection circuit 146 is arranged to detect k=1 intermediate states (selected from among states 0 to 215) of secondary counter 144 during which one auxiliary control pulse $I_L$ is inhibited upstream of primary counter 141. During one period of 432 seconds, primary counter 141 only <<sees>> 430 pulses. 5 control pulses $I_2$ are thus supplied at the output of primary counter 141 during one period of 432 seconds, i.e. at the mean frequency of 1/86.4 Hz.

The counter by 86 can easily be made by means of a 7 bit binary counter arranged to be initialised after 86 pulses. Likewise, the counter by 216 requires an 8 bit counter arranged to be initialised after 216 bits.

Figure 5B:
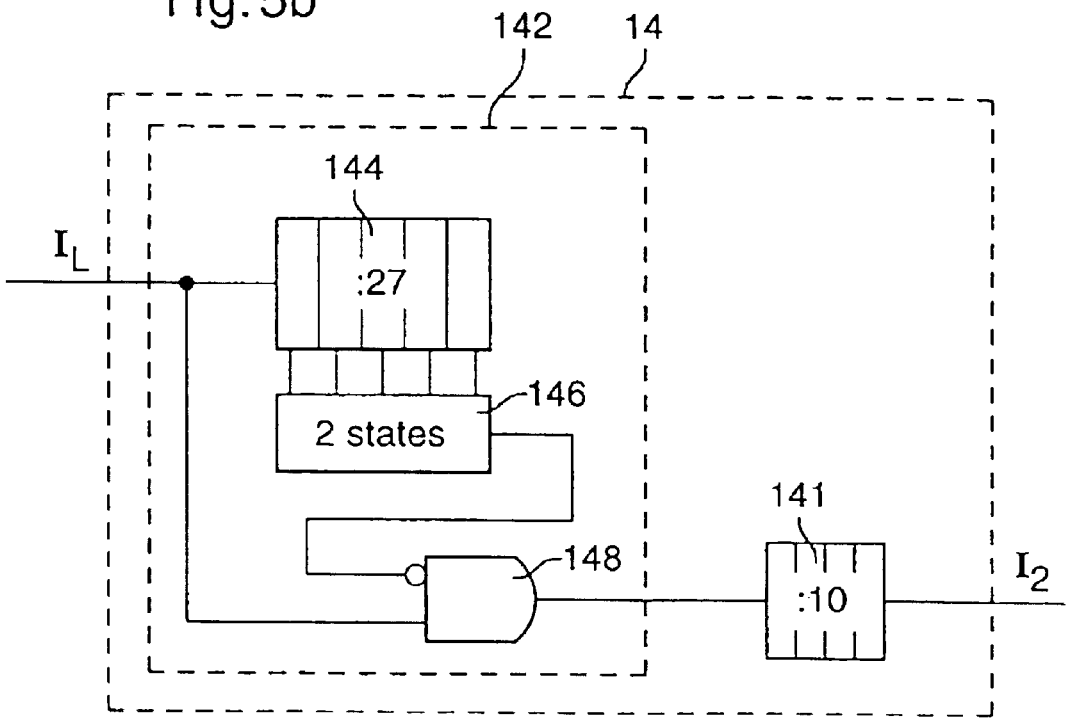

FIG. 5*b* illustrates a second example of the second alternative embodiment shown in FIG. 5 applied to the case in which second control pulses $I_2$ are generated at a mean frequency of 1/86.4 Hz from auxiliary control pulses $I_L$ having a frequency of 118 Hz, i.e. in the case in which generating means 14 are connected to the output of N*=3 additional binary division stages (in accordance with the second embodiment shown in FIG. 2).

It will be recalled that the division ratio between the frequency of auxiliary control pulses $I_L$ and the frequency of the second control pulses is equal in this case to 10.8. Primary counter 141 is thus formed of a counter by n=10. It follows that 4 auxiliary control pulses $I_L$ must be inhibited during the period (432 seconds) in which 54 auxiliary control pulses $I_L$ are supplied, i.e., by simplification, 2 pulses per 27. For this purpose, secondary counter 144 is formed of a counter by m=27 and logic detection circuit 146 is arranged to detect k=2 intermediate states (selected preferably equidistant from among states 0 to 26) of secondary counter 144 during which one auxiliary control pulse $I_L$ is inhibited upstream of primary counter 141. During one period of 432 seconds, primary counter 141 only <<sees>> 50 pulses. 5 control pulses $I_2$ are thus supplied at the output of primary counter 141 during one period of 432 seconds, i.e. at the mean frequency of 1/86.4 Hz.

In this example the counters by 10 and by 27 thus require 4 and 5 bit counters respectively.

Figure 5C:
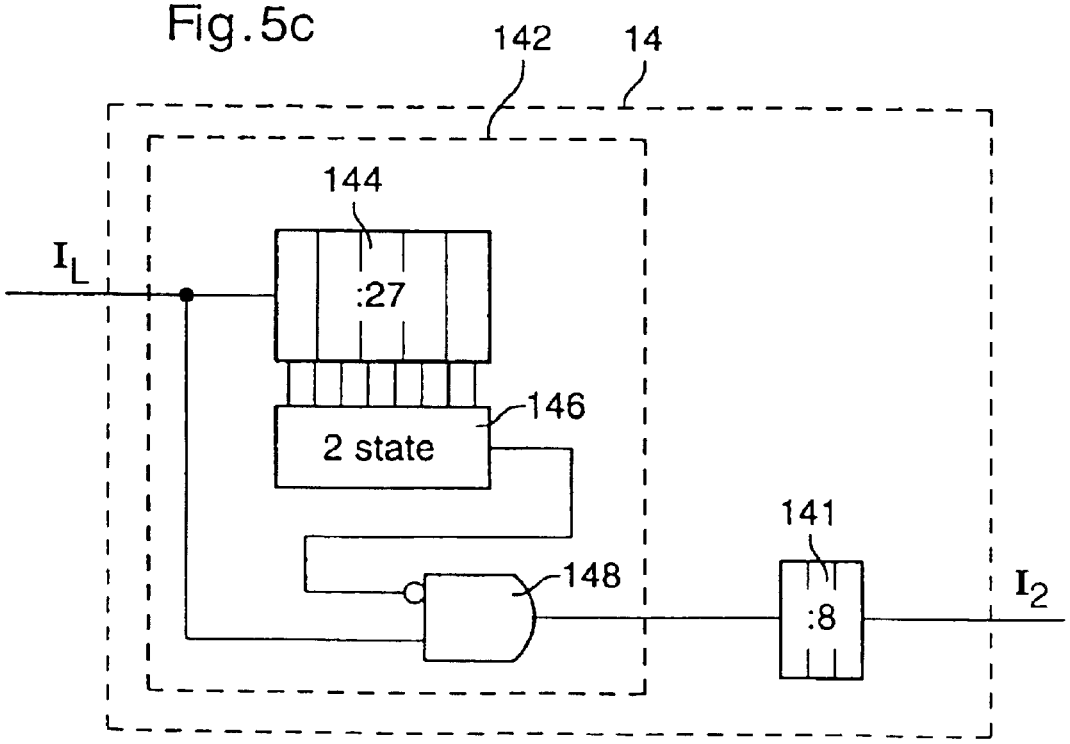

FIG. 5*c* illustrates a third example of the second alternative embodiment shown in FIG. 5 applied to the case in which second control pulses $I_2$ are generated at a mean frequency of 1/8.64 Hz, i.e. 25 pulses during one period of 216 seconds, from auxiliary control pulses $I_L$ having a frequency of 1 Hz, i.e. in the case in which generating means 14 are connected to the output of the last binary division stage 4.N of frequency divider circuit 4 (in accordance with the first embodiment shown in FIG. 1).

It will be recalled that the division ratio between the frequency of auxiliary control pulses $I_L$ and the frequency of the second control pulses is equal in this case to 8.64. Primary counter 141 is thus formed of a counter by n=8. It follows that 16 auxiliary control pulses $I_L$ must be inhibited during the period (216 seconds) in which 216 auxiliary control pulses $I_L$ are supplied, i.e., by simplification, 2 pulses per 27. For this purpose, secondary counter 144 is formed of a counter by m=27 and logic detection circuit 146 is arranged to detect k=2 intermediate states (selected preferably equidistant from among states 0 to 26) of secondary counter 144 during which one auxiliary control pulse $I_L$ is inhibited upstream of primary counter 141. During one period of 216 seconds, primary counter 141 only <<sees>> 200 pulses. 25 control pulses $I_2$ are thus supplied at the output of primary counter 141 during one period of 216 seconds, i.e. at the mean frequency of 1/8.64 Hz.

In this example the counters by 8 and by 27 thus require 3 bit and 5 bit counters respectively.

It is to be noted that numerous examples of the second alternative embodiment, which cannot all be shown here, can also be achieved. It will be noted that the frequency of auxiliary control pulses $I_L$ defines the accuracy with which second control pulses $I_2$ are supplied. Indeed, the higher the frequency of auxiliary control pulses $I_L$, the greater the accuracy with which second control pulses $I_2$ are supplied. However, it will be noted that this involves on the other hand thus use of counters including a significant number of stages.

FIG. 6 illustrates a third alternative embodiment of generating means 14 allowing second control pulses $I_2$ to be supplied.

As is shown in FIG. 6, these generating means 14 include a primary counter 241 arranged to count n+1 auxiliary control pulses $I_L$, and initialisation means 242 coupled to primary counter 241. Second control pulses $I_2$ are supplied at the output of primary counter 241 and are used to control initialisation means 242 so as to initialise periodically primary counter 241 with a value k corresponding to a complementary number of auxiliary control pulses $I_L$.

Initialisation means 242 preferably include a secondary counter 244 arranged for counting m second control pulses $I_2$ and an initialisation circuit 246 coupled to the different stages of primary counter 241 so as to periodically initialise the latter, i.e. after m pulses $I_2$ have been supplied, with a value k corresponding to the complementary number of auxiliary control pulses $I_L$ necessary for primary counter 241 to supply second control pulses $I_2$ at the appropriate mean frequency.

Thus, after the generation of m control pulses $I_2$, primary counter 241 is periodically initialised with a value k so as to compensate for the missing auxiliary control pulses $I_L$.

Figure 6A:
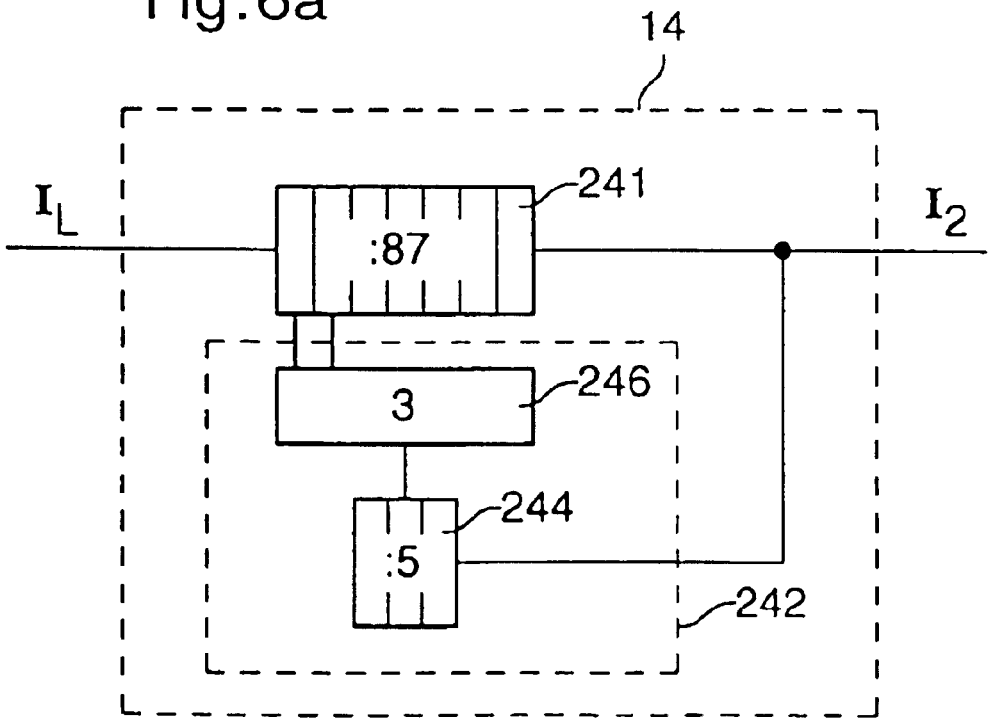
FIG. 6*a* shows an example of the application of the third alternative embodiment of generating means 14 illustrated in FIG. 6.

FIG. 6*a* illustrates an example of the third alternative embodiment shown in FIG. 6 applied to the case in which second control pulses $I_2$ are generated at a mean frequency of 1/86.4 Hz from auxiliary control pulses $I_L$ having a frequency of 1 Hz, i.e. in the case in which generating means 14 are connected to the output of the last binary division stage 4.N (4.15) of frequency divider circuit 4 (in accordance with the first embodiment shown in FIG. 1).

It will be recalled that the division ratio between the frequency of auxiliary control pulses $I_L$ and the frequency of the second control pulses is equal in this case to 86.4.

Primary counter 241 is thus formed of a counter by n+1=87. It follows that the latter has to be initialised every 432 seconds with a start value k=3 corresponding to the complementary number of auxiliary control pulses $I_L$. For this purpose, secondary counter 244 is formed of a counter by m=5 and initialisation circuit 246 is arranged to inject the value k=3 into the first two stages of primary counter 241 as the start value.

During one period of 432 seconds, primary counter 241 thus counts 435 pulses. 5 control pulses $I_2$ are thus supplied at the output of primary counter 241 during one period of 432 seconds, i.e. at the mean frequency of 1/86.4 Hz.

In this example, the counters by 87 and by 5 require 7 and 3 bit counters respectively.

It will be noted finally that several modifications and/or improvements can be made to the timepiece according to the present invention without departing from the scope thereof. It will thus be recalled in particular that additional display means may be provided so as to allow additional time related data based on the H-M-S or decimal system to be formed and displayed.

What is claimed is:

1. An electronic timepiece allowing display of at least a first time related data item and a second time related data item, said first time related data item, being based on the Hour-Minute-Second system, is displayed by a display, this timepiece including:

a time base supplying pulses to a frequency divider circuit including N binary division stages, wherein N is an integer wherein the frequency divider circuit is arranged to supply first control pulses allowing said first time related data item to be formed and displayed by the display; and generating means arranged to supply, from auxiliary control pulses originating from said time base, second control pulses allowing said second time related data item to be formed and displayed by the display, wherein said second time related data item is based on a decimal system in which time is divided at least into thousandths of a day and wherein said second time related data item is displayed with three digits so that said second time related data item cannot be confused with said first time related data item.

2. The electronic timepiece according to claim 1, wherein said generating means are arranged to count successively the auxiliary control pulses in accordance with a counting sequence formed of counting operations of n and n+1 auxiliary control pulses succeeding each other in accordance with a determined order so that said generating means supply the second control pulses at a mean frequency allowing said second time related data item based on the decimal system to be formed, n being an integer number directly less than the division ratio of the frequency of said auxiliary control pulses by the frequency of said second control pulses.

3. The electronic timepiece according to claim 2, wherein said counting operations of n and n+1 auxiliary control pulses follow each other in accordance with an order determined so that the second control pulses are supplied with minimum time error.

4. The electronic timepiece according to claim 2, wherein said counting sequence is comprised in a table including as many entries as there are counting operations.

5. The electronic timepiece according to claim 4, wherein said table is formed of a binary word in which the binary value <<0>> indicates that n auxiliary control pulses must be counted and the binary value <<1>> indicates that n+1 auxiliary control pulses must be counted.

6. The electronic timepiece according to claim 4, wherein the entries of said table are indexed by means of a register containing a value of said second time related data item.

7. The electronic timepiece according to claim 2, wherein said counting operations of n or n+1 auxiliary control pulses are determined by means of a register containing a value of said second time related data item.

8. The electronic timepiece according to claim 1, wherein said generating means include a primary counter arranged for counting n auxiliary control pulses, and inhibition means for said primary counter arranged for periodically inhibiting k auxiliary control pulses upstream of said primary counter, wherein k is an integer so that the primary counter supplies the second control pulses at a mean frequency allowing said second time related data item based on the decimal system to be formed, n being an integer number directly less than the division ratio of the frequency of said auxiliary control pulses by the frequency of said second control pulses.

9. The electronic timepiece according to claim 8, wherein said inhibition means include a secondary counter arranged for counting m auxiliary control pulses, a logic detection circuit coupled to said secondary counter so as to detect k intermediate states thereof, and an AND logic gate including two inputs, one input being inverted and connected to an output of said logic detection circuit and the other input receiving said auxiliary control pulses, wherein said logic detection circuit sends an inhibition signal blocking the AND logic gate when one of the k intermediate states is detected so that one auxiliary control pulse is inhibited upstream of said primary counter.

10. The electronic timepiece according to claim 9, wherein said k intermediate states are selected so as to be equidistant from each other.

11. The electronic timepiece according to claim 1, wherein said generating means include a primary counter arranged for counting n+1 auxiliary control pulses, and initialization means coupled to said primary counter and arranged for periodically initializing said primary counter with a value k wherein k is an integer corresponding to a complementary number of auxiliary control pulses so that said primary counter supplies the second control pulses at a mean frequency allowing said second time related data item based on the decimal system to be formed, wherein n+1 is an integer number directly greater than the division ratio of the frequency of said auxiliary control pulses by the frequency of said second control pulses.

12. The electronic timepiece according to claim 11, wherein said initialization means include a secondary counter arranged for counting m second control pulses and an initialization circuit coupled to said primary counter, said secondary counter providing a signal to said initialization circuit every m second control pulses so that said primary counter is initialized with a value k.

13. The electronic timepiece according to claim 1, wherein said auxiliary control pulses are supplied at an output of one of the binary division stages of said frequency divider circuit.

14. The electronic timepiece according to claim 1, wherein said auxiliary control pulses are supplied at an output of N* additional binary division stages connected after said frequency divider circuit upstream of said generating means.

15. The electronic timepiece according to claim 1, wherein said generating means supply said second control pulses at a mean frequency of 1/8.64 Hz.

16. The electronic timepiece according to claim 1, wherein said generating means supply said second control pulses at a mean frequency of 1/86.4 Hz.

17. The electronic timepiece according to claim 1, wherein the first time related data item is based on the Hour-Minute-Second system that consists of dividing a day into 24 hours, with 1 hour being divided into 60 minutes, and with 1 minute being divided into 60 seconds.

18. The electronic timepiece according to claim 1, wherein the second time related data item is based on the decimal system that consists of dividing a day into 10 tenths of a day, with each tenth of a day being divided into 10 hundredths of a day, and with each hundredth of a day being divided into 10 thousandths of a day.

19. The electronic timepiece according to claim 1, wherein the display includes a first display and a second display, and the first display displays the first time related data item and the second display displays the second time related data item.

20. The electronic timepiece according to claim 19, wherein the first display includes either four digits or first and second hands.

21. An electronic universal timepiece allowing display of at least a first time related data item and a second time related data item, the first time related data item, being based on the Hour-Minute-Second system that consists of dividing a day into 24 hours, with 1 hour being divided into 60 minutes, and with 1 minute being divided into 60 seconds, is displayed by a display, the timepiece comprising:

a time base supplying pulses to a frequency divider circuit, the frequency divider circuit including N binary division stages, wherein N is an integer wherein the frequency divider circuit is arranged to supply first control pulses allowing the first time related data item to be formed and displayed by the display; and generating means arranged to supply, from auxiliary control pulses originating from the time base, second control pulses allowing the second time related data item to be formed and displayed by the display;

wherein the first time related data item is formed and displayed by the display as hours and minutes, either with four digits or first and second hands for displaying hours and minutes in the Hour-Minute-Second system;

wherein the second time related data item is based on a decimal system that consists of dividing a day into 10 tenths of a day, with each tenth of a day being divided into 10 hundredths of a day, and with each hundredth of a day being divided into 10 thousandths of a day, and wherein the second time related data item is displayed by the display in the decimal system as tenths, hundredths and thousandths of a day with three digits.

* * * * *